US007029303B2

(12) United States Patent
Bordeau et al.

(10) Patent No.: US 7,029,303 B2
(45) Date of Patent: Apr. 18, 2006

(54) HERMAPHRODITIC HANDLE SOCKET ASSEMBLY AND PIN ASSEMBLY

(75) Inventors: James Leo Bordeau, Sidney, NY (US); David Otis Gallusser, Oneonta, NY (US)

(73) Assignee: Amphenol Corporation, Sidney, NY (US)

( * ) Notice: Subject to any disclaimer, the term of this patent is extended or adjusted under 35 U.S.C. 154(b) by 0 days.

(21) Appl. No.: 10/854,171

(22) Filed: May 27, 2004

(65) Prior Publication Data

US 2005/0266718 A1 Dec. 1, 2005

(51) Int. Cl.
*H01R 13/28* (2006.01)

(52) U.S. Cl. ..... 439/286; 332/333; 332/337; 332/316; 332/738

(58) Field of Classification Search ..... 439/286, 439/294, 332, 333, 335, 337, 314, 316, 737, 439/738, 318

See application file for complete search history.

(56) References Cited

U.S. PATENT DOCUMENTS 2,171,726 A * 9/1939 Howell ..... 439/286
2,729,798 A * 1/1956 Graham ..... 439/286
3,245,028 A * 4/1966 Badger ..... 439/289
3,252,124 A * 5/1966 Hansen ..... 439/291
3,482,205 A * 12/1969 Senior ..... 439/332
3,784,964 A * 1/1974 Newman et al. ..... 439/603
4,146,288 A * 3/1979 Ramsay et al. ..... 439/316
4,418,946 A * 12/1983 Gambon ..... 285/73
4,695,110 A 9/1987 Wasserlein
4,702,539 A 10/1987 Cousick, III et al.
4,923,413 A 5/1990 Michaels
4,963,102 A 10/1990 Gettig et al.
5,118,303 A * 6/1992 LeBaron et al. ..... 439/286
5,174,777 A 12/1992 Carter
5,890,922 A 4/1999 Buchter et al.
6,368,133 B1 * 4/2002 Zeiler et al. ..... 439/321
6,808,407 B1 * 10/2004 Cannon ..... 439/314

* cited by examiner

*Primary Examiner*—Gary F. Paumen
(74) *Attorney, Agent, or Firm*—Blank Rome LLP

(57) ABSTRACT

A electrical cable assembly with hermaphroditic coupling with a high current rating, is disclosed. The electrical cable assembly with hermaphroditic coupling includes a pin contact terminal in a first coupling sleeve and a hyperboloid socket terminal in a second coupling sleeve. The pin contact terminal may be inserted within the second coupling sleeve, and the hyperboloid socket terminal may be inserted within the first coupling sleeve. The socket contact may include a RADSOK® socket. The first and second coupling sleeves are coupled together by urging the pin contact terminal into the hyperboloid socket terminal and rotating.

24 Claims, 2 Drawing Sheets

HERMAPHRODITIC HANDLE SOCKET ASSEMBLY AND PIN ASSEMBLY

FIELD OF THE INVENTION

This invention relates to the field of electrical cable coupling assemblies, and in particular, to a hermaphroditic coupling mechanism for a cable contact arrangement. The coupling mechanism is hermaphroditic, however, once the pin or socket contacts are installed it becomes gender specific.

BACKGROUND OF THE INVENTION

It is well known to provide electrical cables with contacts which can be easily fitted together to electrically connect the cables. An example of an especially convenient cable contact is the pin and socket contact. The pin and socket contact permits connection of two cables by simply sliding a pin on one cable into a socket on the other. One type of widely used pin and socket contact, is the in-line insertion type.

Electrical apparatuses of various types are often required to include a convenient, simultaneous connection/disconnection for a plurality of in-series conductors. Automotive vehicles for example, represent a typical environment wherein it is desired to provide for the quick assembly of a plurality of conductors in series. As is well known, today's automobiles employ a rather sophisticated electrical system containing many wiring harnesses involving hundreds of circuits transmitted throughout the engine compartment, the vehicle interior and the trunk. To facilitate not only the initial assembly of the vehicle, but also to accommodate subsequent repair, and testing and replacement, it is important that releasable connectors be utilized throughout the numerous involved wiring harnesses. With the influx of computer control systems, it becomes necessary to allow for the in-line insertion of electronic instruments for checking the digital circuits, not only in vehicles but in an assortment of various other apparatus. It is most desirable that an improved conductor termination be provided, not only to insure the highest possible amperage rating, but also to permit quick and positive insertion and retention of the terminations within a connector housing. A RADSOK® termination provides such a termination.

RADSOK® is the trademark for a patented high performance hyperboloid socket and pin-style electrical contact system for applications 30 amps and above. The hyperboloid connectors offer superior performance when compared with standard pin and socket connectors. In the RADSOK® terminal, multiple contacting elements are hyperbolically arrayed around the inner diameter of the socket. In addition, each of the contact elements is skewed with respect to the axial direction of the terminal. The result is multiple contact surfaces that comprise a contact grid. The hyperbolic configuration results in a mechanical interference between an inserted pin and the contact elements. When a pin is inserted into the socket, the contacting elements of the grid mechanically wrap around the pin providing pressure necessary for superior electrical connection.

Because it is desirable to design pin and socket contacts to be as simple as possible, many of the conventional contact arrangements lack any sort of durable, but simple latching mechanism. Continuous use in which strain is placed on the cables in a direction that would cause the contacts to pull apart is prevalent in the industry. Current methods of providing a latching mechanism by trapping the contacts inside an elaborate connector have been lacking in structural integrity. One solution has been to combine the mating and un-mating mechanism with the latching mechanism combined.

Thus, a need exists in the industry to provide an in-line cable assembly which has a pin end and a socket end, and allows a higher current rating such as that provided with a RADSOK® socket, and provides an adequate latching mechanism.

SUMMARY OF THE INVENTION

The present invention provides a system and method for electrically coupling a pin contact to a socket contact for in an hermaphroditic electrical cable assembly.

Briefly described, in architecture, a preferred embodiment of the system, among others, can be implemented as follows. A pin contact terminal is provided and is removably attached within a first coupling sleeve. Two latch arms are provided, integrally molded to an exterior surface of the coupling sleeve. A latch ear is provided at one end of each latch arm to engage with two grooves in the coupling sleeve to form ramp surfaces. A RADSOK® socket terminal is removably attached within another coupling sleeve and will subsequently couple to the first coupling sleeve upon installation. The second coupling sleeve is structured as described above. The first and second coupling sleeves are interlocked by inserting the pin contact terminal into the RADSOK® socket terminal and rotating the latch arms in a clockwise rotation. The twisting movement mates the latch ears of the first coupling sleeve to the grooves in the second coupling sleeve, and the latch ears of the second coupling sleeve to the grooves of the first coupling sleeve.

In another embodiment of the present invention the electrical cable assembly with hermaphroditic coupling is structured in a welding receptacle pin or socket assembly. Numerous socket and contact retention methods may be used to retain the wire conductors within the receptacles.

In one embodiment the electrical cable assembly with hermaphroditic coupling is disposed in a welded handle pin or socket assembly. In that embodiment, various pressure screw wire terminations may be used to secure the conductors within the cable assembly.

Other systems, methods, features, and advantages of the present invention will become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout several views.

DETAILED DESCRIPTION OF THE PREFERRED EMBODIMENT

FIGS. 1–4 illustrate a preferred embodiment of a electrical cable assembly with hermaphroditic coupling 100 installed within a conventional welding handle.

Figure 1:
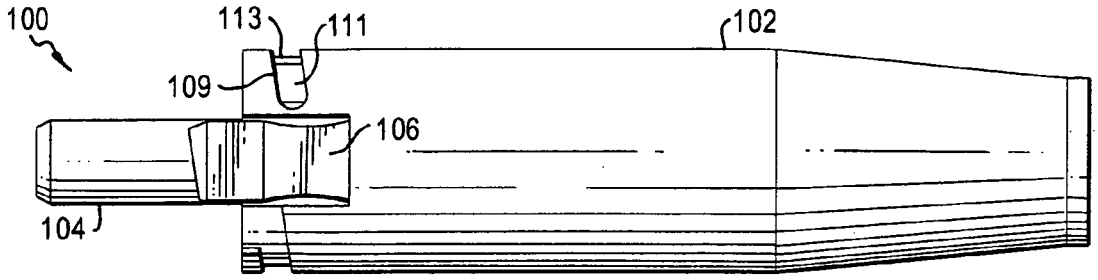
FIG. 1 is a drawing of a perspective view of a pin assembly in accordance with the invention in a welding handle.
Figure 2:
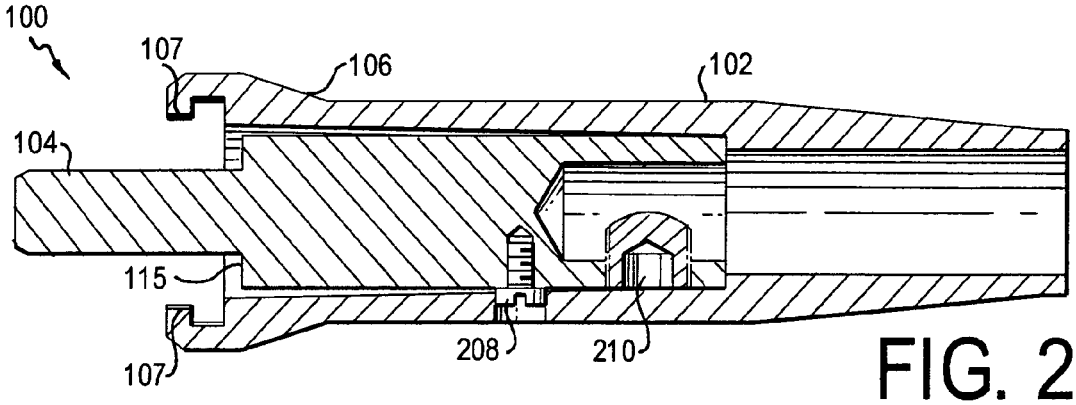
FIG. 2 is a cross-sectional drawing of the pin assembly depicted in FIG. 1.

In FIGS. 1 and 2, a coupling sleeve 102 includes two latch arms 106 that are integrally molded to an exterior surface of the coupling sleeve 102. The latch arms 106 are positioned radially opposite each other on the coupling sleeve 102. A latch ear 107 is disposed at one end of each latch arm 106. The latch ears 107 are used to interlock two coupling sleeves 102 together. FIG. 2 illustrates the latch arms 106 with corresponding latch ears 107 positioned radially opposed to each other.

Two grooves 109 are present on the exterior surface at one end of the coupling sleeve 102 and extend around the circumference of the sleeve between the latch arms. The grooves 109 form a ramp surface 111 to accept the latch ears 107 of a second coupling sleeve 102. A raised detent 113 is positioned on the ramp surface 111 to resist rotational movement of the latch ear 107 within the groove 109 when the coupling sleeves are latched together.

A pin contact terminal 104 is inserted and held on with a screw 208 within an interior cavity 115 of the one end of the coupling sleeve 102. A contact retention/locator screw 208 locates and secures the pin contact terminal 104 within the cavity 115 of the coupling sleeve 102. In this embodiment, the coupling sleeve 102 includes one pressure screw 210 to secure a wire conductor when positioned in the other end of the coupling sleeve 102. At least one pressure screw 210 is used to secure the wire conductor to the contact terminal.

Figure 3:
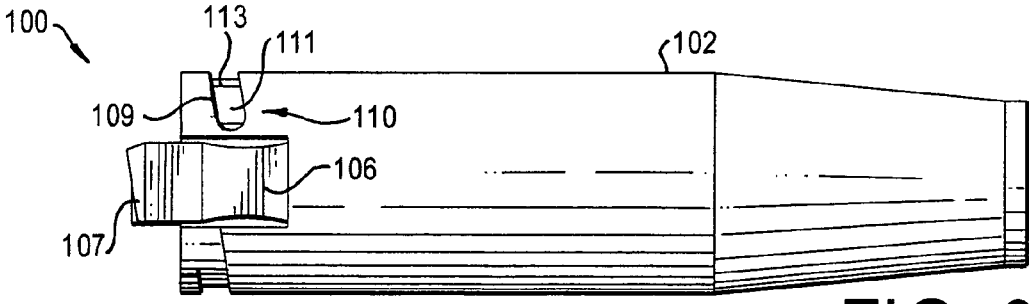
FIG. 3 is a drawing of a perspective view of a socket assembly in accordance with the invention in a welding handle.
Figure 4:
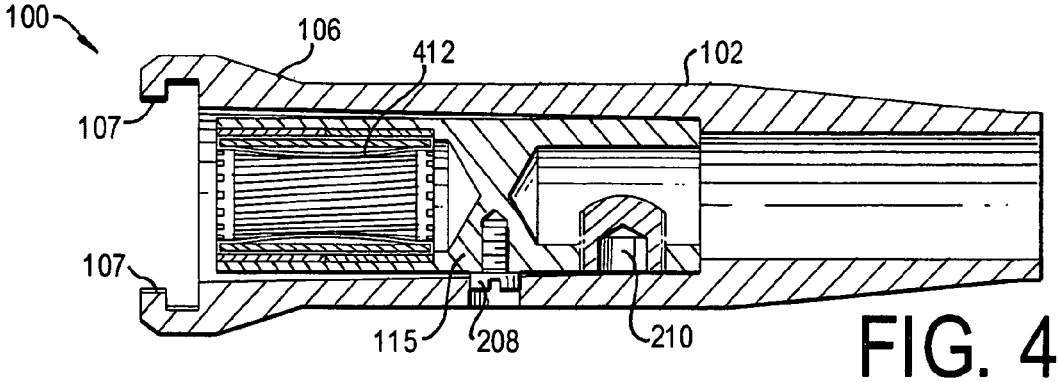
FIG. 4 is a drawing of a cross-sectional view of the socket assembly depicted in FIG. 3.

FIGS. 3 and 4 illustrate a second coupling sleeve 102 with a hyperboloid socket terminal 412 inserted within the cavity 115 of the coupling sleeve 102. In the preferred embodiment, the hyperboloid socket terminal 412 is a RADSOK® socket terminal. A contact retention/locator screw 208 secures the hyperboloid socket terminal 412 within the coupling sleeve 102. At least one pressure screw 210 is used to secure a wire conductor to the terminal when positioned in the other end of the coupling sleeve 102.

To couple the coupling sleeve 102 with the pin contact terminal 104, to the coupling sleeve 102 with the hyperboloid socket terminal 412, the pin contact terminal 104 is urged into the hyperboloid socket terminal 412. The latch ears 107 of the two coupling sleeves 102 inserted into grooves 109 through openings 110 and are aligned with the grooves 109. Once aligned, a clockwise rotational movement of the opposing coupling sleeves interlocks the latch ears 107 within the grooves 109 along the ramp surfaces 111. The rotational movement of the two coupling sleeves is impeded when the latch ears 107 encounter the raised detents 113. The raised detents 113 present an obstacle to further rotational movement of the latch ears 107 within the grooves 109, and can be overcome with forceful urging of the latch ears 107 within the grooves 109. The raised detents 113 are a resistive obstacle to overcome when uncoupling the coupling sleeves 102. The raised detents 113 also hamper any unwanted loosening of the coupled coupling sleeves 102.

FIGS. 5–8 illustrate another embodiment of a cable assembly with hermaphroditic coupling 500 installed within a conventional welding receptacle.

Figure 5:
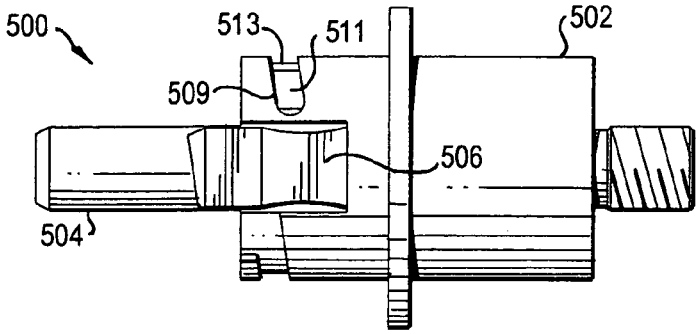
FIG. 5 is a drawing of a perspective view of a pin assembly in accordance with the invention in a welding receptacle.
Figure 6:
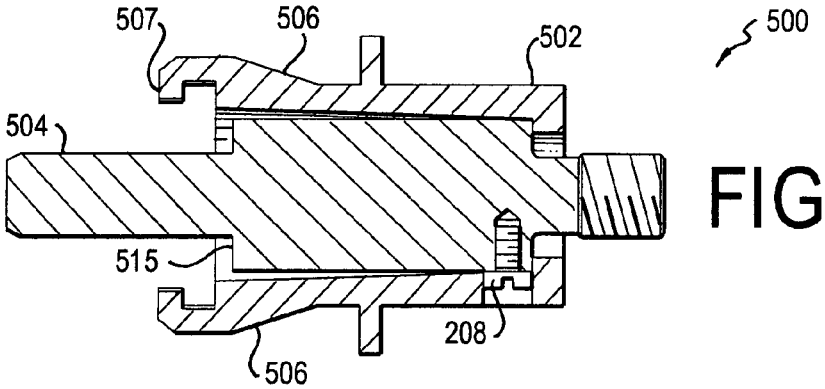
FIG. 6 is a drawing of a cross-sectional view of a pin assembly depicted in FIG. 5.

In FIGS. 5 and 6, the coupling sleeve 502 includes two latch arms 506 that are integrally molded to an exterior surface of the coupling sleeve 502. The latch arms 506, latch ears 507, grooves 509, ramp surface 511, raised detent 513, and pin contact terminal 504 are structured and arranged in an orientation as described above for the preferred embodiment for the welding handle. The pressure screws 210 are omitted in this embodiment because the structure of the welding receptacle does not require a termination device for a conductor termination.

Figure 7:
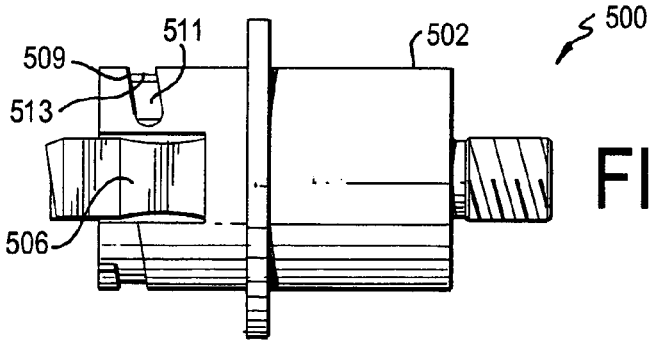
FIG. 7 is a drawing of a perspective view of a socket assembly in accordance with the invention in a welding receptacle.
Figure 8:
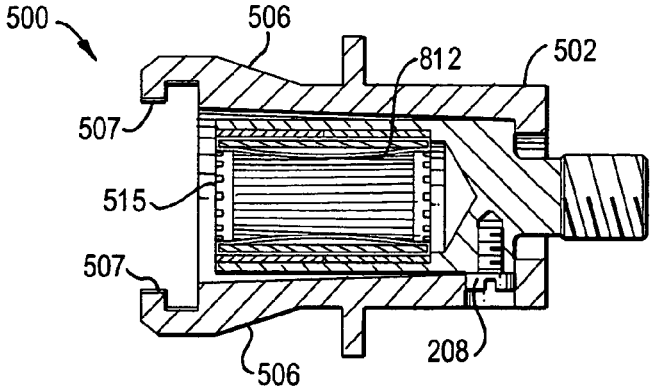
FIG. 8 is a drawing of a cross-sectional view of a socket assembly depicted in FIG. 7.

In FIGS. 7 and 8, the pin contact terminal 504 depicted in FIGS. 5 and 6 is replaced with the hyperboloid socket terminal 812 as illustrated in FIGS. 3 and 4. Pressure screws are not needed because the structure of the welding receptacle does not require a termination device for a conductor termination and hence, are omitted. The remaining structural elements duplicate those included in FIGS. 5 and 6.

With regard to coupling, the coupling sleeves illustrated in FIGS. 5 and 6 are coupled to the coupling sleeves illustrated in FIGS. 7 and 8, using the same rotational procedure as described above for FIGS. 1–4.

It should be emphasized that the above-described embodiments of the present invention, particularly, any preferred embodiments, are merely possible examples of implementations, merely set forth for a clear understanding of the principles of the invention. Many variations and modifications may be made to the above-described embodiments of the invention without the departing substantially from the spirit and principles of the invention. All such modifications and variations are intended to be included herein within the scope of this disclosure and the present invention, and protected by the following claims.

What is claimed is:

1. A electrical cable assembly with hermaphroditic coupling comprising:

a coupling sleeve;

at least two latch arms extending from an exterior surface of the coupling sleeve and spaced apart from each other at a first end of the coupling sleeve;

at least two grooves disposed on a portion of the exterior surface at the first end of the coupling sleeve between the two spaced-apart latch arms, wherein the longitudinal axis of the at least two grooves is in the shape of a helix and wherein a portion of the bottom surface of the at least two grooves forms a ramp;

a latch ear disposed at one end of each of the latch arms, wherein the latch ear is oriented at substantially the same angle as the longitudinal axis of the grooves; and a pin contact terminal press-fit within an interior cavity at the first end of the coupling sleeve.

2. The electrical cable assembly with hermaphroditic coupling of claim 1, wherein the ramp surfaces include a raised detent to resist a rotational movement of the latch ears within the grooves.

3. The electrical cable assembly with hermaphroditic coupling of claim 1, wherein the pin contact terminal is removably attached within the coupling sleeve.

4. The electrical cable assembly with hermaphroditic coupling of claim 1, wherein at least one contact retention/locator screw secures a socket terminal within the coupling sleeve.

5. The electrical cable assembly with hermaphroditic coupling of claim 1, wherein the coupling sleeve includes at least one pressure screw for securing a wire conductor.

6. The electrical cable assembly with hermaphroditic coupling of claim 1, wherein the terminal includes a pin contact terminal.

7. The electrical cable assembly with hermaphroditic coupling of claim 1, wherein the terminal includes a hyperboloid socket terminal.

8. The electrical cable assembly with hermaphroditic coupling of claim 7, wherein the hyperboloid socket terminal is removably attached within the coupling sleeve.

9. The electrical cable assembly with hermaphroditic coupling of claim 7, wherein one contact retention/locator screw secures the pin contact terminal within the coupling sleeve.

10. The electrical cable assembly with hermaphroditic coupling of claim 7, wherein two contact retention/locator screws secure the pin contact terminal within the coupling sleeve.

11. The electrical cable assembly with hermaphroditic coupling of claim 7, wherein the coupling sleeve includes one pressure screw for securing a wire conductor.

12. The electrical cable assembly with hermaphroditic coupling of claim 10, wherein one contact retention/locator screw secures the hyperboloid contact terminal within the coupling sleeve.

13. The electrical cable assembly with hermaphroditic coupling of claim 10, wherein two contact retention/locator screws secure the hyperboloid contact terminal within the coupling sleeve.

14. The electrical cable assembly with hermaphroditic coupling of claim 1, wherein the coupling sleeve includes a welding handle.

15. The electrical cable assembly with hermaphroditic coupling of claim 1, wherein the coupling sleeve includes a welding receptacle.

16. The electrical cable assembly with hermaphroditic coupling of claim 7, wherein the coupling sleeve includes a welding handle.

17. The electrical cable assembly with hermaphroditic coupling of claim 7, wherein the coupling sleeve includes a welding receptacle.

18. The electrical cable assembly with hermaphroditic coupling of claim 10, wherein the coupling sleeve includes a welding handle.

19. The electrical cable assembly with hermaphroditic coupling of claim 10, wherein the coupling sleeve includes a welding receptacle.

20. A electrical cable assembly with hermaphroditic coupling comprising:

a coupling sleeve;

two latch arms extending from an exterior surface of the coupling sleeve and spaced apart from each other at one end of the coupling sleeve;

at least two grooves disposed on a portion of the exterior surface at the first end of the coupling sleeve between the two spaced-apart latch arms, wherein the longitudinal axis of the at least two grooves is in the shape of a helix and wherein a portion of the bottom surface of the at least two grooves forms a ramp;

a latch ear disposed at one end of each of each latch arms, wherein the latch ear is oriented at substantially the same angle as the longitudinal axis of the grooves;

a raised detent within each groove to resist rotational movement of the latch ears within the grooves; and a pin contact terminal removably inserted within an interior cavity at the one end of the coupling sleeve.

21. A electrical cable assembly with hermaphroditic coupling comprising:

a coupling sleeve;

two latch arms extending from an exterior surface of the coupling sleeve and spaced apart from each other at one end of the coupling sleeve;

at least two grooves disposed on a portion of the exterior surface at the first end of the coupling sleeve between the two spaced-apart latch arms, wherein the longitudinal axis of the at least two grooves is in the shape of a helix and wherein a portion of the bottom surface of the at least two grooves forms a ramp;

a latch ear disposed at one end of each latch arm, wherein the latch ear is oriented at substantially the same angle as the longitudinal axis of the grooves;

a raised detent within each groove to resist rotational movement of the latch ears within the grooves; and a hyperboloid socket terminal inserted within an interior cavity at the one end of the coupling sleeve.

22. A method for coupling a electrical cable assembly with hermaphroditic coupling, said method comprising:

providing a first coupling sleeve with two latch arms integrally molded to an exterior surface of said first coupling sleeve and radially positioned opposite each other at one end of the first coupling sleeve;

providing a second coupling sleeve with two latch arms integrally molded on an exterior surface of said second coupling sleeve radially positioned opposite each other at one end of the second coupling sleeve;

disposing at least two grooves, each on the exterior surface at the one end of said first and second coupling sleeves and forming ramp surfaces, wherein the longitudinal axis of the at least two grooves is in the shape of a helix;

providing a latch ear disposed at one end of each latch arm, wherein the latch ear is oriented at substantially the same angle as the longitudinal axis of the grooves;

inserting a pin contact terminal within an interior cavity at the one end of the first coupling sleeve;

inserting a hyperboloid socket terminal within an interior cavity at the one end of the second coupling sleeve; and coupling the pin contact terminal to the hyperboloid socket terminal by aligning the latch ears of the first coupling sleeve with the two grooves of the second coupling sleeve while concurrently aligning the latch ears of the second coupling sleeve with the grooves of the first coupling sleeve and rotating the latch arms of the first and second coupling sleeves in a clockwise direction.

23. The method according to claim 22, further comprising:

securing the pin contact terminal and the hyperboloid socket terminal with at least one retention/locator screw within said first and second coupling sleeves, respectively.

24. The method according to claim 22, further comprising:

providing raised detents on the ramp surfaces to resist rotational movement of the latch ears within the grooves when coupling the pin contact terminal to the hyperboloid socket terminal.

* * * * *

UNITED STATES PATENT AND TRADEMARK OFFICE

CERTIFICATE OF CORRECTION

PATENT NO. : 7,029,303 B2
APPLICATION NO. : 10/854171
DATED : April 18, 2006
INVENTOR(S) : Bordeau et al.

It is certified that error appears in the above-identified patent and that said Letters Patent is hereby corrected as shown below:

Col. 1, line 39, change “apparatus.” to --apparatuses.--

Col. 4, line 37, delete “the” (second occurrence).

Signed and Sealed this

Nineteenth Day of June, 2007

JON W. DUDAS
*Director of the United States Patent and Trademark Office*